United States Patent [19]

Ralston

[11] Patent Number: 4,697,493

[45] Date of Patent: Oct. 6, 1987

[54] TREMOLO CONTROL ARM RETAINER

[76] Inventor: James E. Ralston, 13627 Leadwell Street, #1, Van Nuys, Calif. 91405

[21] Appl. No.: 910,236

[22] Filed: Sep. 19, 1986

[51] Int. Cl.[4] ..... G10D 3/00

[52] U.S. Cl. ..... 84/313

[58] Field of Search ..... 84/313

[56] References Cited

U.S. PATENT DOCUMENTS

| | | | |
|---|---|---|---|
| 3,326,072 | 6/1967 | Price | 84/313 |
| 4,317,403 | 3/1982 | Franzmann | 84/313 |
| 4,475,432 | 10/1984 | Stroh | 84/314 N |

*Primary Examiner*—Lawence R. Franklin

*Attorney, Agent, or Firm*—Roger A. Marrs

[57] ABSTRACT

A guitar tremolo control arm retainer is disclosed herein for releasably holding the arm in a selected position so that the basic tuning of the instrument is not altered during the playing of the instrument. The retainer is secured to the guitar and includes a U-shaped anchor member or yoke having a lateral opening for insertably receiving the tremolo arm. The anchor member is movably and resiliently carried on a support rod mounted on a bracket for vertical movement and a keeper is adjustably mounted on the bracket secured to the guitar for holding the anchor member in a selected position on the rod. Guide arrangement is provided between the anchor member and the bracket while a pliable insert occupies the opening of the member for yieldably bearing against the arm when inserted into the opening of the anchor member.

5 Claims, 6 Drawing Figures

TREMOLO CONTROL ARM RETAINER

BACKGROUND OF THE INVENTION

1. Field of the Invention

The present invention relates to electric guitars having a stringed bridge of the type including mechanisms for producing tremolo and, more particularly, to such a guitar incorporating a releasable retainer for maintaining the arm of such a tremolo device in a fixed settable position.

2. Brief Description of the Prior Art

Stringed instruments such as guitars are frequently fitted with, or originally provided with, a device known as a "tremolo" device. As is the usual practice, a tremolo device is anchored to the face of the guitar and includes the bridge end of the strings. The other end of the strings is at the nut which is near the position where the strings may be tightened or loosened by customary means. Adjustment of the tremolo device and therefore the tension on the strings is achieved by means of manipulation of a lateral extending arm which outwardly projects from a portion of a movable bridge carried on the instrument. The guitarist manually moves the tremolo arm until the proper or desirable string tones have been achieved and these moves are intentional and controllable. The purpose of the tremolo device is to allow a guitarist to intentionally alter an existing string tone or existing string tones by an increase or decrease of string tension by manipulation of the tremolo arm. The tone changes are impressive and useful to a guitarist.

However, during the course of play, many inadvertent changes or modifications may be experienced which disturb the tune of the strings. These may be due to the bending pressures, broken strings, stretching of strings or by involuntary application of pressure to the bridge such as by resting of the player's palm thereon. Any change or modification to the setting or tune of one string will adversely affect the setting or tune of the others.

Therefore, a need has existed to provide a means for maintaining and stabilizing the strings in a properly tensioned condition regardless of the aforementioned problems. Such a retaining device may cooperate with the conventional tremolo arm as a means for positive string stabilization.

SUMMARY OF THE INVENTION

Accordingly, the above problems and difficulties are obviated by the present invention which provides a novel retaining means for a tremolo device whereby the movable arm of the device is held in a desired position after tension-setting of the respective strings on an instrument. In one form of the invention, the retainer includes a bracket mounted on the face of the guitar which includes a supporting rod on which an anchoring means is movably mounted. Resilient means forcibly urges the anchor means towards one end of the bracket. The anchor means further includes a recess having an opening for insertably receiving the tremolo arm so that the arm is captured within the anchor means. An adjustable retaining means carried on the bracket holds the anchor means in a desired position so that regardless of pressures placed upon the tremolo arm, the arm cannot move from its settable position or location until released.

A feature of the present invention provides for an insert carried on the anchor means for releasably holding the tremolo arm in position.

One of the primary objects of the present invention is to provide a novel retaining means for a tremolo arm included in a tremolo device combination which is adjustably settable to hold the tremolo arm in a fixed position so that undesired changes in string tension will not cause the tremolo arm to move from a desired setting.

Another object of the present invention is to provide a novel anchoring means for a tremolo arm whereby the arm is maintained in a fixed position with respect to the face of the guitar so that settable tension on the respective guitar strings is maintained.

A further object of the present invention is to provide a novel anchoring means for use in combination with a tremolo arm whereby string stabilization is maintained regardless of inadvertent changes in tension of any one string so that the remaining strings are unaffected as the instrument is being played.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1:
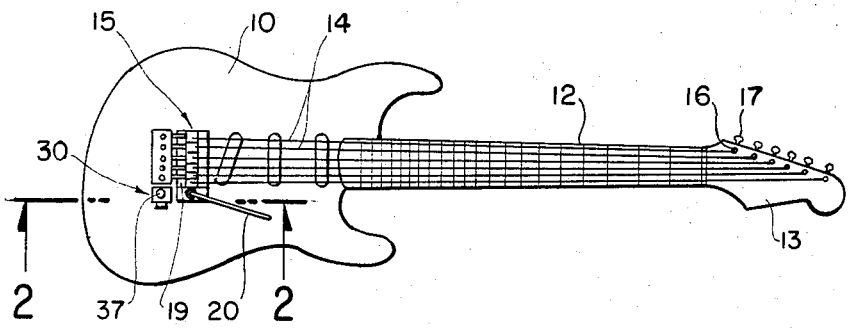
FIG. 1 is a top plan view of a conventional guitar having a tremolo device and incorporating the present invention.

Referring to FIG. 1, a guitar is illustrated of conventional construction with the exception of the tremolo retaining device incorporating the present invention as described further below. In general, the guitar includes a sound board or body portion 10 from which a neck 12 projects and which terminates at its opposite end in a head portion 13. Several parallel strings 14 have their opposite ends anchored, respectively, to a bridge arrangement indicated by arrow 15 that is carried by the body 10 and the conventional tension or tuning mechanism in the form of upright ends 16 rotatable by turning adjustment screws 17. As is conventional with guitars fitted with tremolo devices, the bridge portion of the guitar includes a bridge mounting plate 19 which is movable by manipulation of a control handle or arm 20 so as to effect rapid but slight alterations in the string tension and thereby produce a tremulous tone effect. As shown in more detail in FIG. 2, the tremolo device incorporated into the bridge arrangement 15 includes the mounting of the movable bridge mounting plate 19 to the body portion 10 of the guitar. In one form of tremolo device, the mounting plate 19 terminates at one end in a flange 21 having a definite tapered angle which enters a mating angle groove 22 in the neck 12. The groove 22 extends laterally across the stem beneath the strings 14 and the flanged end of the mounting plate 19 is held in position by means of a mounting screw 23. It is to be understood that a plurality of mounting screws may extend laterally across the front end of the body plate 19. The leading edge of the mounting plate 19 decreases in thickness towards its sharp end fitted in the groove 22.

The tension of the guitar strings 14 tends to pull the bridge plate 19 upward; however, this force is offset by the tension of a return spring or springs 24 connected between the underside of the guitar stem and an upright mounting block 25 rigidly connected to the underside of the bridge mounting plate 19. Sliding of the bridge mounting plate transversely of the length of the guitar is not permitted because the groove 22 does not extend to the opposite ends of the angle plate mounting groove.

Conventionally, the upright mounting block 25 for a movable bridge has upright bores for receiving the individual guitar strings with the strings being anchored at the base of the block. Since this is conventional construction, further details are not illustrated or shown at this time since they do not form a part of the present invention. However, to adjust the tension on the strings, the guitarist need only position the arm 20 up or down as is illustrated in broken lines. The tremolo arm is also rotatable on its mounting nut 26 for added control purposes.

Figure 2:
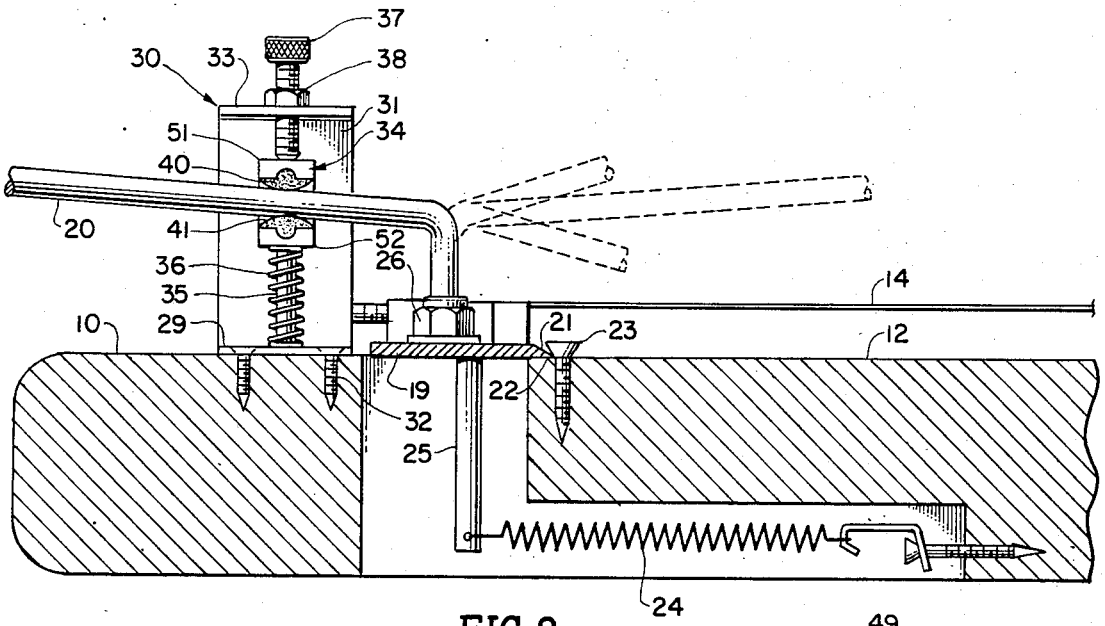
FIG. 2 enlarged sectional view of the restraining or anchoring means of the present invention used in combination with the tremolo device as taken in the direction of arrows 2—2 of FIG. 1.

Still referring to FIG. 2, the major improvement of the present invention is a provision of a mechanism for retaining or latching the bridge mounting plate 19 in a fixed position relative to the body 10 of the guitar. As is conventional, the perpendicularly bent control handle 20 of the tremolo device may be turned through an angle of at least 180° between an operating position in which its upper end portion extends forwardly generally lengthwise of the guitar to a position extending transversely of the guitar and away from the bridge. The operative position is shown in broken lines while the inoperative position is shown in solid lines. The novel retaining or latch mechanism incorporated into the tremolo device is illustrated in the general direction of arrow 30 which includes a mounting bracket 31 carried on the body 10 by a plurality of attachment screws, such as screw 32. The bracket 31 includes upper and lower flanges 33 and 29 respectively which are arranged in fixed spaced apart relationship so as to define an operating area for the anchoring or retaining means taking the form of an open-ended yoke or anchor element 34. The yoke or anchor element 34 rides up and down in a vertical direction on a support rod 35 carried between the flanges 33 and 29. A compression spring 36 forcibly urges the retaining or latch element 35 against the underside of an adjustment means taking the form of a manually operated screw 37 threadably engagable with the flange 33. A lock nut 38 maintains the screw 37 in a settable position so that the retaining or latch element 34 can be locked into position on the support rod 35 against the expanding pressure of spring 36.

It is to be noted that the retaining or latch element 34 serving as the anchor for the tremolo arm 20 insertably receives the arm between upper and lower elements having opposing surfaces which define a retaining space for the arm. The arm is disposed between pliable elements or pads 40 and 41 which define a space between their opposing surfaces to receive opposite sides of the tremolo arm 20.

Figure 3:
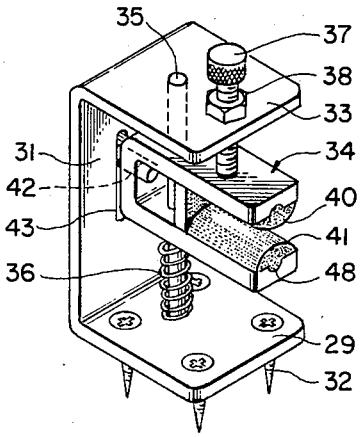
FIG. 3 is a front perspective view of the novel tremolo restraining means of the present invention.
Figure 4:
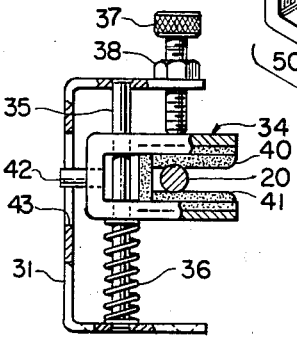
FIG. 4 is a side elevational view, partly in section, of the restraining device.

As shown more clearly in FIGS. 3 and 4, a guide for the retainer or latch element 34 is provided in the form of a pin 42 which outwardly extends through a slot 43 carried on the backside of a bracket 31. Therefore, the travel of the element 34 up and down on the support post 35 is controlled within the limits of the end of the slot 43. Also, the element cannot turn on the support post 35 because of the pin engaging with the sidewalls of the bracket 31 defining the slot 43.

Reference is made to FIG. 4 wherein it can be seen that the tremolo arm 20 is insertably received between the opposing surfaces of the pliable or resilient pads 40 and 41 respectively. Therefore, the tremolo arm can be moved laterally in and out of the opening leading into the area between the opposing surfaces of the pads, but cannot be moved in a vertical direction due to the firm retention of the element 34 in its fixed position on the support rod 35 by the adjustment screw 37 and the spring 36.

Figure 5:
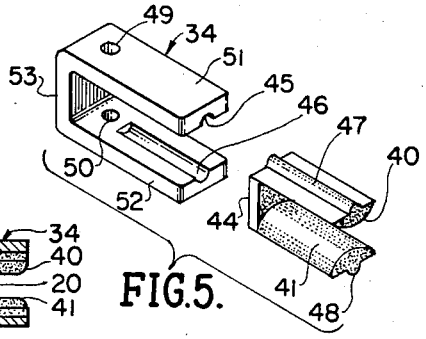
FIG. 5 is an exploded perspective view of the anchor means employed in the restraining device of FIGS. 3 and 4.
Figure 6:
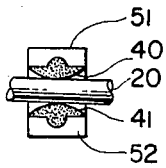
FIG. 6 is a front elevational view of the anchoring means shown in FIG. 5 when assembled.

Referring now in detail to FIGS. 5 and 6, it can be seen that the resilient pads 40 and 41 may form a one-piece construction joint at their opposite ends by a connector piece 44. Also, the single construction of the pads makes it possible to insert the pads as a unit into grooves 45 and 46 respectively by means of elongated keys 47 and 48 carried on the respective pads 40 and 41. Preferably, the grooves or keyways 45 and 46 are located opposite each other and terminate at one end adjacent to aligned holes 49 and 50 through which the supporting rod 35 normally passes. It can be seen that the retainer or latch element 34 includes an upper leg 51 and a lower leg indicated by numeral 52 which are joined together by a common back piece 53. Defined between the opposing surfaces of the legs 51 and 52 is a retention space intended to be occupied by the tremolo arm 20. With the pads 40 and 41 inserted as shown in FIG. 5 onto the respective legs 51 and 52, the tremolo arm 20 is captured therebetween. Since the material or composition of pads 40 and 41 is of a pliable or resilient matter, such as hard rubber or the like, the tremolo arm is fixedly held.

Therefore, it can be seen that once the musician or guitarist has adjusted the tremolo arm to the proper height or elevation so that the bridge plate 19 is properly angled to tension the strings 14, the position of the arm is locked into place by swinging the arm laterally into the retaining or latch element 34 between the opposing surfaces of the pads 40 and 41. The screw 37 is adjusted through the nut 38 to prevent the element 34 from raising while the spring tension of spring 36 against the underside of the element 34 keeps the tremolo arm from depressing. The nut 38 can be tightened against the upper bracket flange 33 so that a fixed arrangement is provided and the tremolo arm cannot move vertically. Consequently, the tension and pitch of an individual string or group of strings can be altered manually without causing swinging movement of the bridge mounting plate which would normally alter the tensions of all the other strings. With the control arm swung forward as shown in broken lines in FIG. 2, the latch arm is free and the retainer or latch element 34 and the control arm 20 can be manipulated to produce a desired tremulous tone effect.

In other words, the inadvertent disturbances of one string to another during the playing of the instrument is prevented by the inventive retaining device. This device utilizes and operates through the tremolo arm and its attendant construction to hold the string in the position set prior to play.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A retainer for stabilizing the strings of a guitar having a tremolo device with a tremolo arm, the combination comprising;

a tremolo arm;

a retaining means mounted on the guitar operable in cooperation with said tremolo arm to hold said tremolo arm in a fixed position whereby inadvertent de-tuning of the guitar strings in avoided;

said retaining means includes a bracket carried on the guitar adjacent to the tremolo device; and a holder movably mounted on said bracket having an opening leading into a holding cavity for insertably receiving said tremolo arm;

guide means interconnecting said holder with said bracket permitting limited vertical movement of said holder with respect to said bracket; and resilient means contracted between said holder and bracket normally biasing said holder in a selected vertical direction.

2. The invention as defined in claim 1 wherein:

said bracket includes a mounting rod slidably carrying said holder.

3. The invention as defined in claim 2 including:

a resilient pad carried on said holder within said holding cavity yieldably bearing against said tremolo arm.

4. The invention as defined in claim 3 wherein:

said holder is a U-shaped yoke having a lateral opening.

5. The invention as defined in claim 4 including:

an adjustment means disposed between said bracket and said yoke for selectively locating said yoke with respect to said bracket against said resilient bias.

* * * * *